United States Patent [19]

Boeckmann et al.

[11] Patent Number: 4,949,527

[45] Date of Patent: Aug. 21, 1990

[54] METHOD OF FORMING A RECLOSABLE TRAY

[75] Inventors: Hugo Boeckmann, Arlington Heights, Ill.; Steven Ausnit, New York, N.Y.

[73] Assignee: Zip-Pak Incorporated, Northbrook, Ill.

[21] Appl. No.: 414,773

[22] Filed: Sep. 29, 1989

Related U.S. Application Data

[62] Division of Ser. No. 213,161, Jun. 29, 1988, Pat. No. 4,896,775.

[51] Int. Cl.[5] ..... B65B 61/18; B43M 7/00; B65D 33/16; B31B 1/84

[52] U.S. Cl. ..... 53/412; 156/66; 206/601; 383/61; 493/213; 493/390

[58] Field of Search ..... 53/128, 133, 410, 412, 53/416, 420; 156/66; 206/601, 633; 220/315; 229/125.35; 383/61, 65; 493/213, 214, 380, 390

[56] References Cited

U.S. PATENT DOCUMENTS

| | | | |
|---|---|---|---|
| 2,978,769 | 4/1961 | Harrah | 156/66 X |
| 3,219,084 | 11/1965 | Ausnit et al. | 493/215 X |
| 4,022,324 | 5/1977 | Schuster | 53/478 X |
| 4,240,241 | 12/1980 | Sanborn, Jr. | 53/412 |
| 4,246,288 | 1/1981 | Sanborn, Jr. | 426/122 |
| 4,437,293 | 3/1984 | Sanborn, Jr. | 53/412 |
| 4,713,839 | 12/1987 | Peppiatt | 383/61 X |

FOREIGN PATENT DOCUMENTS

| | | | |
|---|---|---|---|
| 1405341 | 9/1975 | United Kingdom | 53/412 |

*Primary Examiner*—Robert L. Spruill
*Assistant Examiner*—Beth Bianca
*Attorney, Agent, or Firm*—Hill, Van Santen, Steadman & Simpson

[57] ABSTRACT

A tray for foodstuffs or the like having a continuous edge rim and a flexible cover placed over the top of the tray and sealed to the rim with an elongate continuous interlockable separate rib and groove profile on strips sealed to the surface of the cover wherein upstanding pull flanges above the rib and groove profiles may be pulled apart and the cover severed between the profiles for access to the contents so that the cover may be opened and closed.

17 Claims, 4 Drawing Sheets

FIG. 17
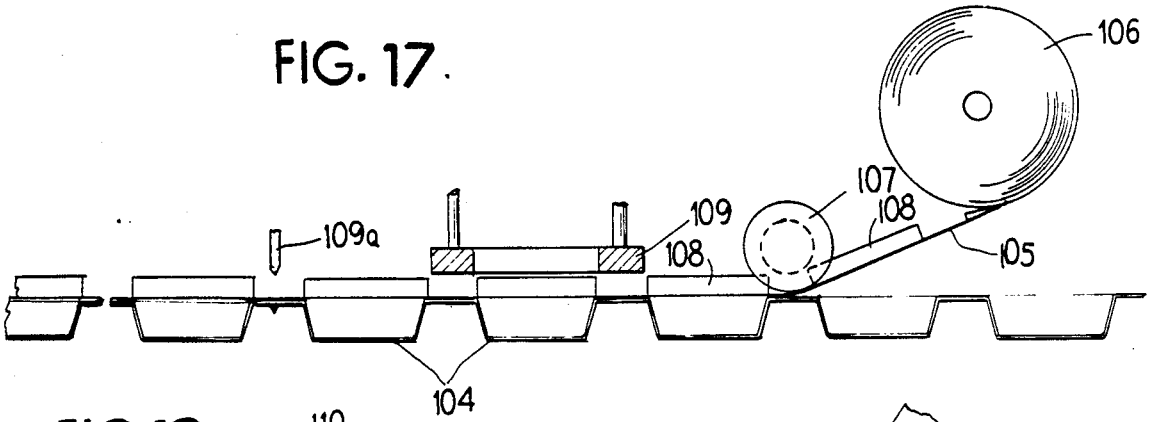
FIG. 19
FIG. 18
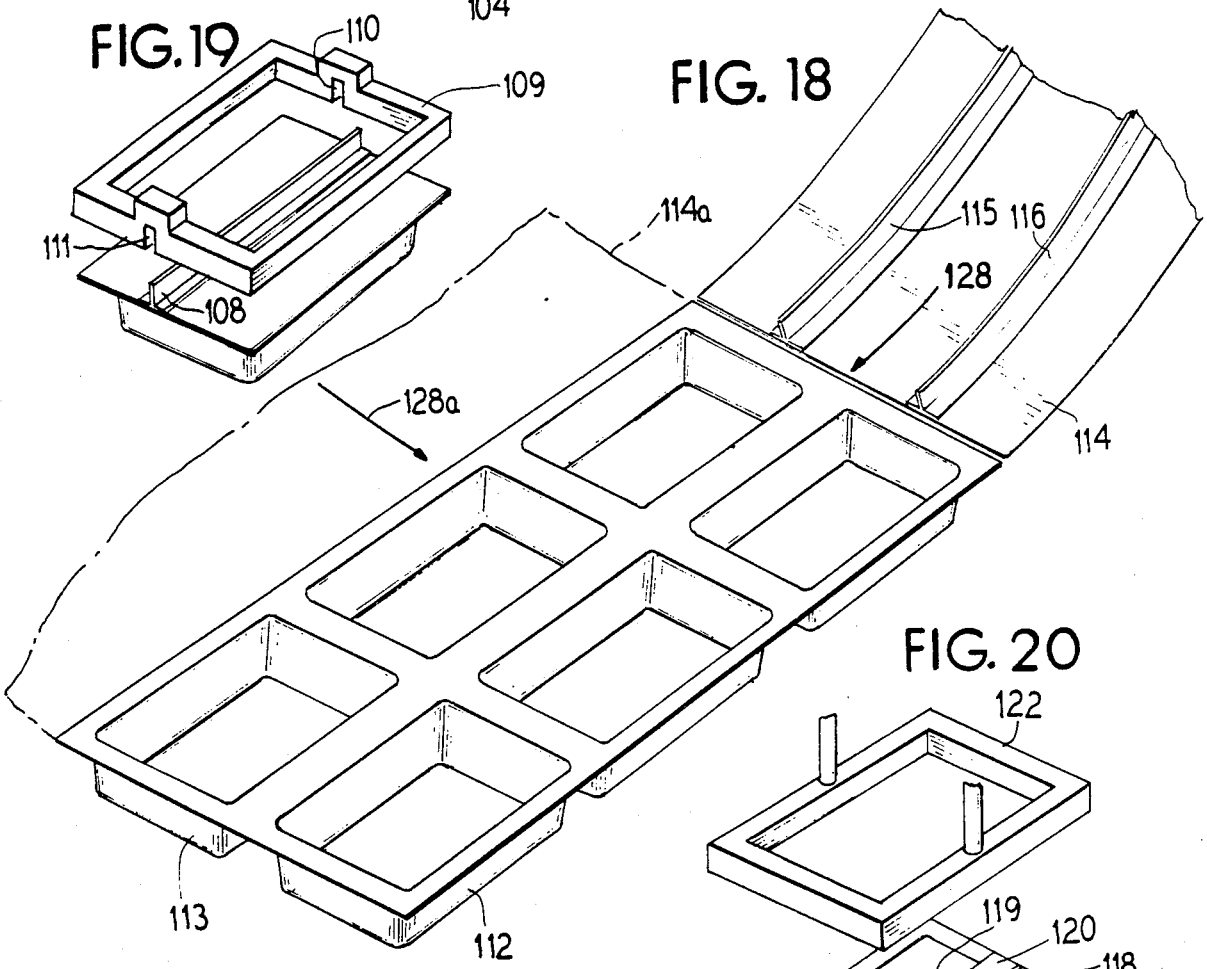
FIG. 20
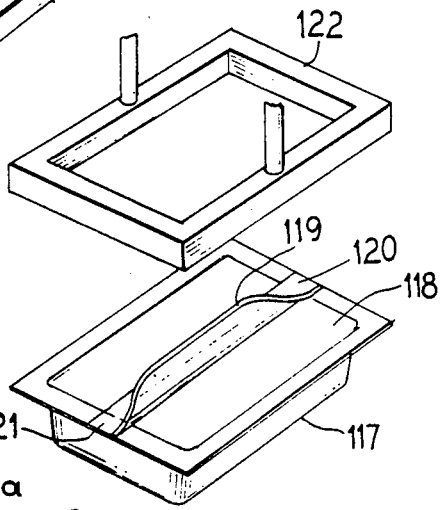
FIG. 21
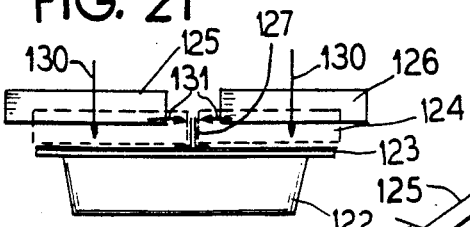
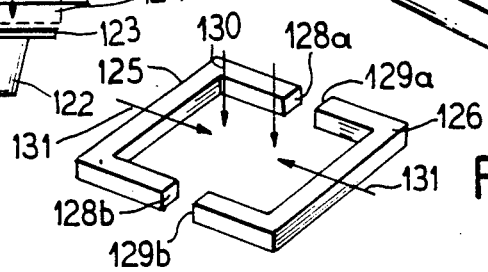
FIG. 22

METHOD OF FORMING A RECLOSABLE TRAY

This is a division, of application Ser. No. 213,161, filed June 29, 1988 now U.S. Pat. No. 4,896,775.

BACKGROUND OF THE INVENTION

The present invention relates to improvements in packaging in plastic trays, and more particularly to methods of making and closing an improved tray structure wherein the cover is provided with a reclosable interlocking zipper.

A substantial number of items including foodstuffs, such as cheese, bacon, processed meat, are sold in packages formed in a tray shape. These packages are generally formed of semiflexible thermoplastic material which is inexpensive to make and offers an amount of rigidity and protection for the product. Such trays are conventionally sealed with a cover over the top which cover can be torn from the tray for access to the contents. However, for products such as foodstuffs which may be partially used from the tray, it is desirable that the tray can be reclosed and this frequently is accomplished by the consumer providing a replacement cover such as of foil or Saran. For attractive merchandising and safety and product integrity for foodstuffs, it is desirable nevertheless that the original package be sealed and preferably sealed in such a manner that it is tamper-evident so that the merchandiser or customer can see when the initial seal has been broken.

In order to preserve the contents in a fresh state without loss of flavor and texture, it is often necessary to completely repackage the product if the temporary replacement cover is inadequate.

SUMMARY OF THE INVENTION

It is accordingly an object of the present invention to provide an improved method of forming and closing a tray for merchandising products which has a cover which is capable of being reclosed for protection of the products once the tray has been opened.

A further object of the invention is to provide a method of attaching a cover for a reclosable tray wherein the cover has tamper-evident features so that although the tray can be reused and reclosed until such time it is obtained by the customer, it is completely sealed and any opening which exposes the contents to the air would be evident.

A further object of the invention is to provide an improved method for closing a reclosable package in a high speed repeatable process.

A further object of the invention is to provide an improved method involving a packaging tray suitable for foodstuffs having a moisture-proof reclosable zipper on the cover wherein the location and construction of the cover and zipper provides improvements over methods and arrangements heretofore available.

In accordance with the principles of the invention, a reclosable tray is provided having a continuous rim at the edge. The tray is formed of a semi-rigid but flexible thermoplastic material which enables the cover to be attached either by heat sealing or by adhesives. The cover preferably is of a see-through material such as polyethylene, or where required a laminate film with appropriate food preserving barrier properties. These can be very thin for reduction of manufacturing costs and uniquely be provided with an openable and reclosable feature.

The reclosable feature is provided by the attachment of a flexible continuous zipper having closure strips with facing pressure interlocking openable rib and groove profiles therealong. The strips are constructed in a manner so that in one form they are laid flat to conform with and be parallel to the horizontal cover and in another form so as to be upstanding with vertically extending pull flanges. The cover can be attached in the most simplified way of one-piece so as to provide a reliable and positive seal for the contents of the tray. The closure strips can be laid directly over the cover without adversely affecting its sealing integrity and yet provide an opening through which the contents can be removed and yet provide a seal which can be positively reclosed to seal the contents against the entry moisture and air or contaminants, and this is particularly advantageous in the case where the tray is used for the merchandising of foodstuffs.

Other objects, advantages and features will become more apparent with the teaching of the principles of the invention with the disclosure of the preferred embodiments thereof in the specification, claims and drawings, in which:

DESCRIPTION OF THE DRAWINGS

FIG. 17 is a somewhat schematic side elevational view illustrating a manner in which a sequence of interconnected trays are closed;

FIG. 18 is a perspective view further illustrating the method shown in FIG. 17;

FIG. 19 is a perspective view illustrating the sealing of a single cover to a tray and the apparatus used for sealing;

FIG. 20 is a perspective view illustrating another apparatus used for closing a tray;

FIG. 21 is a side elevational view illustrating a step in the closing and sealing of a tray; and FIG. 22 is a fragmentary perspective view illustrating structure for sealing a cover having the features of FIG. 21 onto the top of a tray.

DESCRIPTION OF THE PREFERRED EMBODIMENTS

Figure 2:
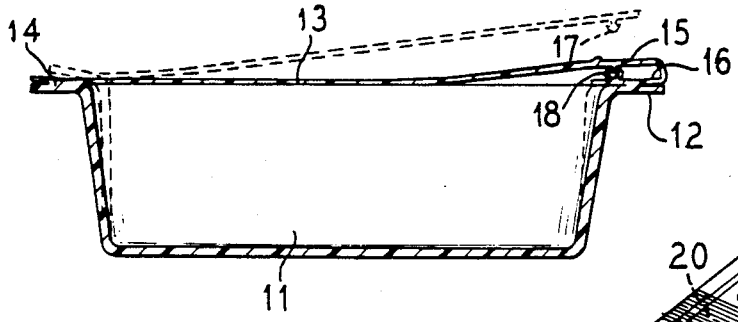
FIG. 2 is a vertical sectional view taken substantially along line II—II of FIG. 1.
Figure 1:
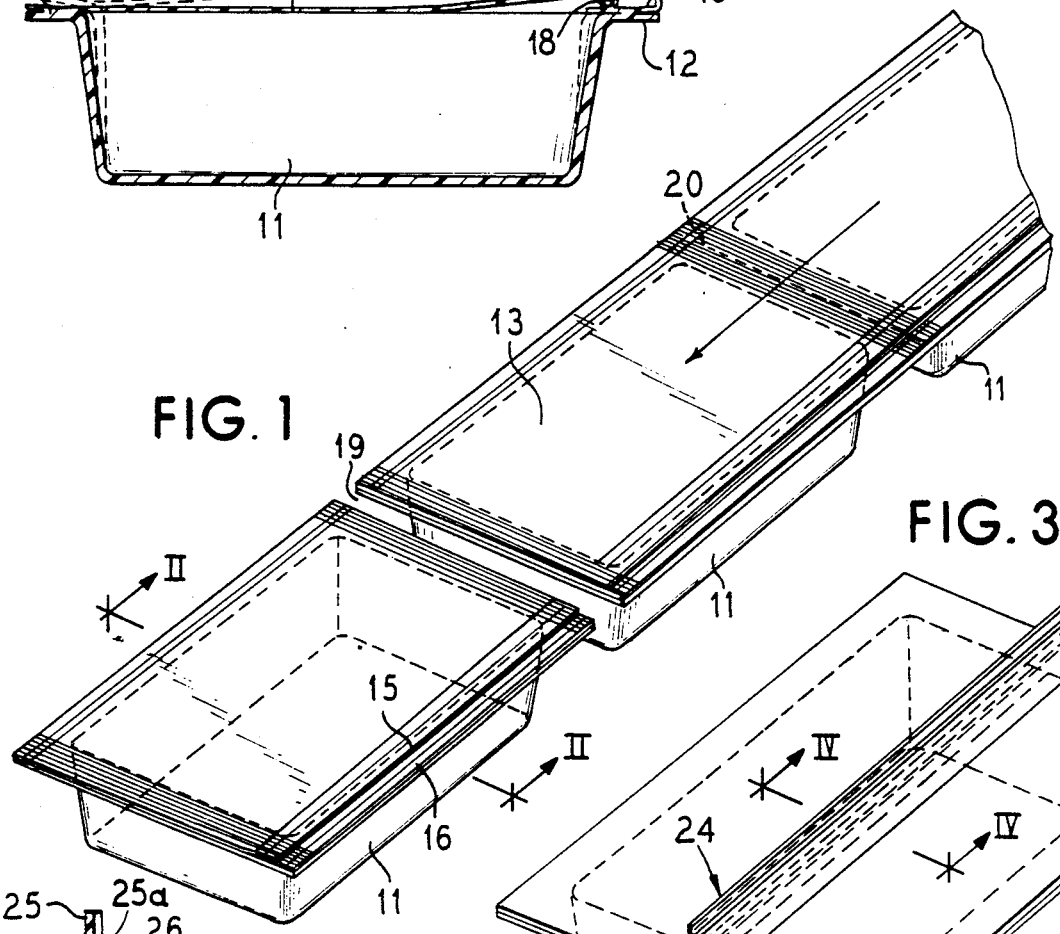
FIG. 1 is a perspective view of a series of trays, being manufactured and closed in accordance with the principles of the present invention.

As illustrated in FIG. 1, a series of preformed trays 11 are provided which trays have a hollow or recessed center portion for receiving foodstuffs, upstanding side walls and a rim 12 which is continuous around the edge at the upper edge of the side walls. Laid over the tray is a cover 13 to protect the contents and the edges of the cover material are sealed to the tray rim. As illustrated in FIG. 2, the cover 13 is sealed to the rim 12 around its periphery as indicated at 14. As illustrated in FIG. 1, this may be accomplished in a continuous manufacturing operation wherein the flexible cover material is fed forwardly as indicated by the arrowed line in FIG. 1 to cover the trays and the trays are interconnected at their ends and the cover material is of one piece to join adjacent trays indicated by the dotted line 20. After individual trays are covered, they are separated as indicated by the separation cut 19. The cover 13 is sealed to the rim 12 of the tray by suitable means such as by joining the plastics by ultrasonic waves, by adhesive, by vibration welding, by radio frequency welding or by other known sealing methods.

In the structure of FIGS. 1 and 2, a reclosable fastener is separate from the cover material with the fastener being formed at the edge of the tray 11 having an upper flange 15 and a lower flange 16. The flanges have between them pressure reclosable openable rib and groove profiles with the rib member shown at 17 and the receiving groove member shown at 18. By gripping the top pull flange 15, the cover can be opened along its edge for access to the contents. Applying a pressure pushing the top pull flange 15 downwardly will rejoin the rib and groove elements to seal the contents against the access of air and moisture.

Figure 2A:
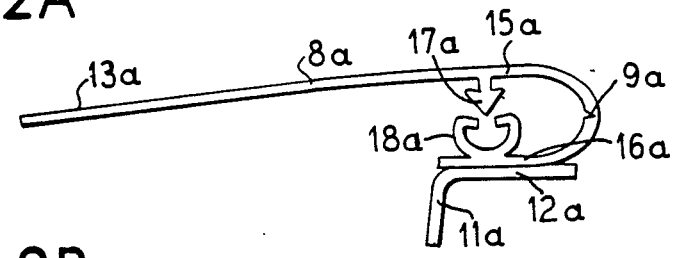
FIG. 2A is a fragmentary sectional view illustrating another form of the fastener of FIG. 2 wherein the reopenable closure is located at the edge of a tray.
Figure 2B:
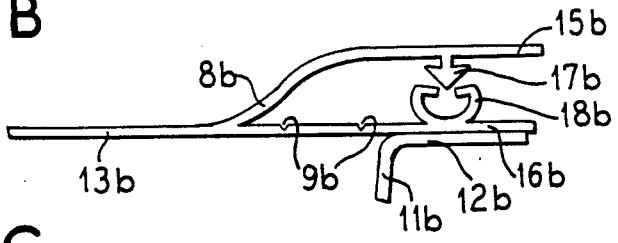
FIG. 2B is a fragmentary sectional view illustrating a further form of fastener similar to FIG. 2 wherein the reopenable closure is located at the edge of a tray.
Figure 2C:
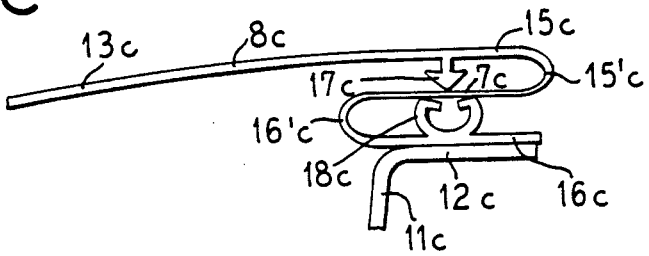
FIG. 2C is a fragmentary sectional view illustrating still another form of fastener similar to FIG. 2 wherein the reopenable closure is located at the edge of a tray.

FIGS. 2A, 2B and 2C illustrate variations in the form of fastener illustrated in FIGS. 1 and 2, which is located at the edge of a tray. The fasteners in FIGS. 2A, 2B and 2C can be arranged to be integral with the film of the cover material (such as the cover shown at 13 in FIGS. 2 or separate as shown in FIG. 1) or the reopenable closure zipper can be fabricated separately and attached to the cover.

With particular reference to FIG. 2A, the tray cover is shown at **13*a*, and a web 8*a* of the fastener is shown integral with the cover, although the web 8*a* could be bonded to the cover. The fastener has a rib profile element 17*a* which is mated to pressure lock into a female groove element 18*a*. The groove fastener is supported on a web 16*a* which is bonded to a rim 12*a* of a tray 11*a***.

The base **16*a* of the fastener is integral with and continuous with a flange 15*a* of the upper fastener part with a line of weakened tear resistance 9*a* formed in the material 15*a* and 16*a*. The continuous material 15*a* and 16*a* is impervious to the entrance of air moisture so that a complete protective seal is formed for the tray 11*a* until the contents are to be used. The tray may be formed with the rib element 17*a* and groove element 18*a*** interlocked or they may be interlocked only after the tray has first been opened.

To open the tray when the contents are to be used, the frangible line of weakened tear resistance **9*a* is broken and the cover lifted. The reclosable fastener can then be resealed for protection of the contents. The flange 15*a* provides a pull flange for opening the tray, and the tray can be resealed by pressing together the rib and groove 17*a* and 18*a* to interlock them. Thus, the continuous doubled portion 15*a* and 16*a*** forms a pilfer-evident protection for the tray so that the purchaser can immediately visually see whether the tray has been improperly opened before his purchase.

FIG. 2B illustrates still another form of the closure for the side of a tray such as that shown in FIGS. 1 and 2. A tray **11*b* has a rim 12*b*. A cover 13*b* extends over the tray to be bonded to the rim. A base flange 16*b* is shown as an integral extension of the cover. However, the fastener including the base flange 16*b* and an upper flange 8*b* may be bonded to the cover 13*b* so that the fastener strip can be manufactured separately. The fastener strip has the lower base flange 16*b* with a groove profile element 18*b* thereon. The upper portion of the fastener has a rib element 17*b* which interlocks into the groove element 18*b*. The upper strip of the fastener has a pull flange 15*b* which extends from the upper flange 8*b***.

The base flange **16*b* is provided with a weakened tear line at 9*b*. The weakened tear line permits breaking the base flange at 9*b* but is moisture and air impervious so as to completely seal the contents of the tray until the tray is to be opened by the user. Thus, the user will have a pilfer-evident cover so that he can visually see whether the tray has been opened before his purchase or not. When the purchaser wishes to use the contents, he lifts up on the pull flange 15*b* to break the line 9*b* of weakened tear resistance to have access to the contents. The tray can then be resealed by pressing the interlocking rib and groove elements 17*b* and 18*b*** together to interlock them.

FIG. 2C illustrates still a further form of reclosable fastener for the edge of a tray **11*c*. The tray has a rim 12*c*. A fastener strip is connected at the edge of the tray with a lower base flange 16*c* bonded to the rim 12*c*. The upper portion of the fastener strip has a web 8*c* which may either be integral with a cover 13*c* for the tray or be bonded thereto. This permits the fastener to be manufactured separately if desired. The upper portion of the fastener strip has a rib element 17c which is shaped and sized to be interlockingly received by a groove element 18c. The upper strip has a pull flange 15c which is turned downwardly at its end as shown at 15'c. The base flange for the lower fastener strip is turned upwardly at its end as shown at 16'c and a flexible film gasket 7c is secured and bonded between the ends 15'c and 16'c to seal the space between the ends. This thin continuous film gasket section 7c is positioned between the profiles 17c and 18c** to provide an air and moisture proof seal to protect the contents. It also provides a tamper-evident seal that has to be broken to get to the contents of the tray so that the purchaser user will know that the tray has not been opened before he received it.

Thus, each of the arrangements of FIGS. 2A through 2C can be made with the upper strip integral with the cover or can be fabricated separately and attached to the cover to provide a tamper-evident closure for the tray.

Figure 3:
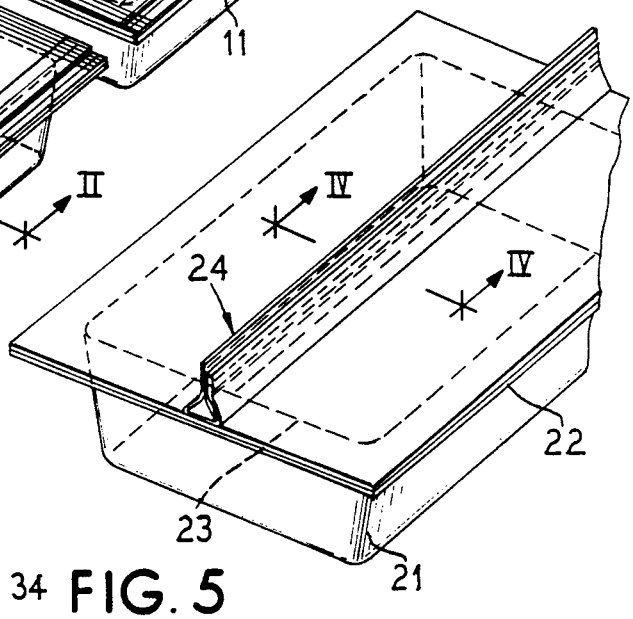
FIG. 3 is perspective view of a tray similar to FIG. 1 but illustrating another form of reopenable closure.
Figure 4:
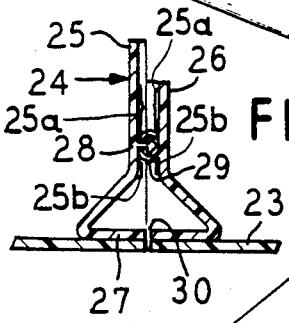
FIG. 4 is an enlarged fragmentary vertical sectional view taken substantially along line IV—IV of FIG. 3 and illustrating a zipper closure employing upstanding pull flanges.

FIGS. 3 and 4 illustrate a modification of the reclosable closure for the tray. A tray 21 has a continuous rim 22 at its upper edge and a flexible cover 23 is laid over the tray, sealed to the rim. In this arrangement, the cover 23 can be formed of a continuous one-piece layer of film which of uniform thickness, is inexpensive, and can be of thin transparent material to make the tray contents visible. With the lower tray of a flexible thermoplastic material and the cover of a thin lightweight thermoplastic material, suitable materials can be provided for each of the cover and tray, each having their optimum characteristic and yet these elements can be readily heat sealed to each other by the application of a mandril or other heat transmitting member applied to the material continuously along the rim.

A closure assembly 24 can be preapplied to the cover 23 or applied after the cover is in place. Preferably with the type of closure shown, it is heat sealed to the cover so that such heat sealing is accomplished prior to the cover being laid over the tray. The closure assembly can be attached to the cover by various known sealing or attachment means such as by ultrasonic welding of the plastics, by adhesive, by vibration welding, by radio frequency welding or the like. It will be understood that such known attachment means may be utilized in joining the various fastener structures to the covers as will be described hereinafter.

The closure 24 is shown of a one-piece doubled unit having side upstanding pull flanges 25 and 26, FIG. 4, which lead downwardly to be joined at a spread base 27 which is heat sealed to the cover 23. The closure zipper 24 has mating interlockable reclosable rib and groove profiles 28 and 29 on the inner faces of the pull flanges 25 and 26. For first attaching the zipper 24 to the cover material, the rib and groove can be separated by pulling the pull flanges apart and a heat seal attachment be formed to secure the base 27 to the surface of the cover. If desired, a line of weakened tear resistance 30 may be added so that at the time of use, the cover can be separated for access to the contents. One preferred form of constructing the line 30 is having the die which seals the bases 27 to the cover form a weakened tear line at the same time the seal is being made. Alternately, a perforation wheel may be used which will travel longitudinally down between the rib and groove profiles after they have been separated to cut through the base 27 and the cover 23. For retaining the air and moisture tightness of the container, these perforations will be sealed by sealing a strip over the perforations. For products not requiring a barrier type film, no sealing strip is needed. If desired, an additional seal can be provided to prevent inadvertent separation at the store by adhesive pads located either above the profiles at 25a or below the profiles at 25b. The pads are not shown joined, but would be attached to each other at the time the tray is filled and closed to adhesively bind to each other to additionally prevent separation of the rib and groove and to provide a further moisture and air-proof seal.

In the structure of FIG. 4, one pull flange 25 is shown as being longer than the other pull flange 26 for convenience of gripping and for initially pulling apart the rib and groove so that the cover can be broken along the perforation line 30 for access to the contents. When the contents are removed, the rib and groove 28 and 29 can be pressed together for resealing the package until further used and until further contents are to be removed, or for reuse of the package with different contents.

Figure 5:
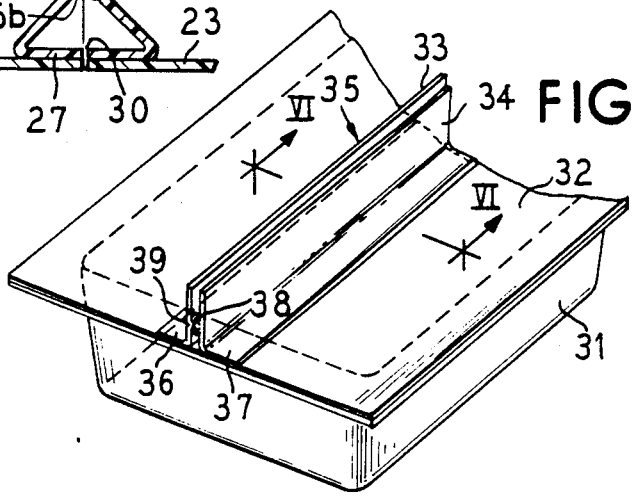
FIG. 5 is a fragmentary view of a tray, similar to FIG. 3, but illustrating another form of closure structure.
Figure 6:
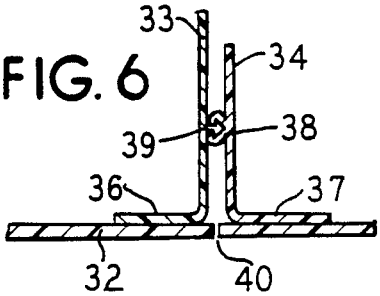
FIG. 6 is an enlarged fragmentary vertical sectional view taken substantially along VI—VI of FIG. 5.

FIGS. 5 and 6 illustrate another form of the zipper closure wherein the zipper is formed in individual separate strips with the zipper 35 being shown having strips with upstanding pull flanges 33 and 34. Again, one of the pull flanges, 33, is longer than 34 for ease of gripping to pull apart an interlocking rib 39 and receiving groove 38. Each of the strips is L-shaped having a base web 36 and 37 which extends laterally outwardly parallel to the surface of a cover 32. The cover 32 is sealed along its edge to the rim of a tray 31 over which the cover is placed.

The lower webs 36 and 37 are adhered or heat sealed to the flat material of the cover 32 in the manner illustrated in FIG. 6. Again, a line of weakened tear resistance such as perforations 40 are placed between the zipper strips along the cover so that when the rib and groove are pulled apart by the pull flanges, the cover may be severed along the line 40 for access to the contents.

Figure 7:
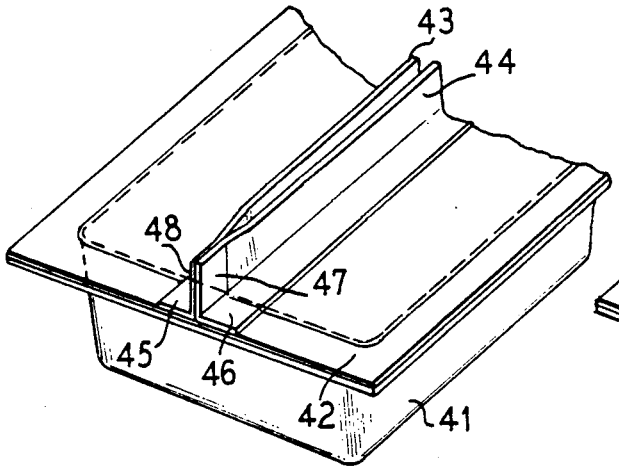
FIG. 7 is a fragmentary perspective view illustrating another form of closure structure.
Figure 8:
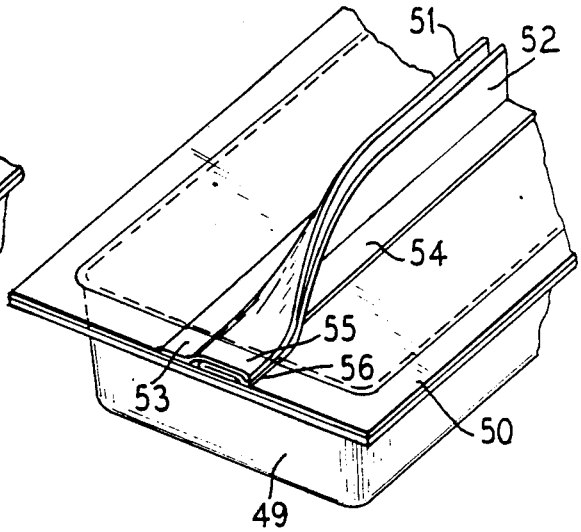
FIG. 8 is a fragmentary perspective view illustrating a further form of closure structure.
Figure 9:
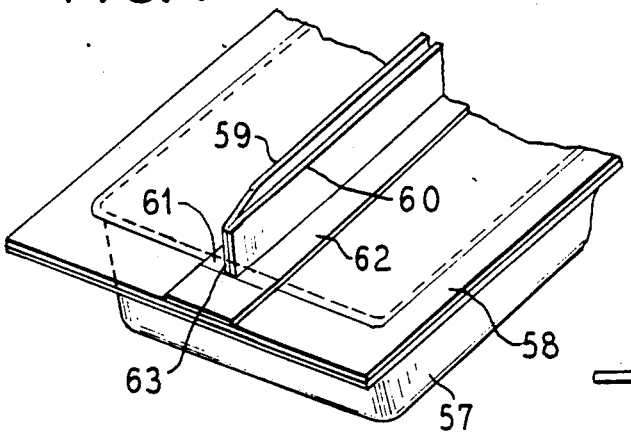
FIG. 9 is a fragmentary perspective view illustrating still another form of closure structure.

FIGS. 7, 8, and 9 respectively illustrate different manners in which the ends of the zipper can be sealed, for convenience, for appearance, and for security in protecting against end leakage between the zipper strips.

In FIG. 7 a tray 41 has a continuous flat cover 42 attached thereto by securing to the rim. Strips 43 and 44 project up above the cover and have web portions 45 and 46 secured to the flat upper surface of the cover. Generally, the web portions 45 and 46 would be sealed to the cover in one operation and the end flanges sealed to each other, at predetermined locations, depending on the size of the tray to which the cover is attached, in a second earlier operation, indexed to the first. The ends of the flanges 43 and 44 are sealed to each other as indicated at 47 and 48 to form a flat web which cannot be separated and this prevents end-wise air leakage between the flanges 43 and 44 when the rib and groove profiles, which are not shown but which are on the inner surface and interlocked, are joined.

In FIG. 8 a tray 49 has a continuous flat thin cover 50 protecting the contents and is sealed to the rim of the tray. An upstanding zipper strip is provided with pull flanges 51 and 52 having interlocking rib and groove profiles on the inner facing surfaces thereof. The base of the pull flanges have webs 53 and 54 which are sealed to the cover 50. The ends of the pull flanges are sealed to each other at 55 and 56 and then flattened and sealed flat against the cover 50 at the ends thereby further preventing outward leakage between the flanges when the container is closed. In this arrangement, the access to the tray is more limited. In each of the instances of FIGS. 7 through 9, access to the contents is obtained by separating the pull flanges and forming a cut through the cover between the flanges for access to the foodstuffs or other material within the tray.

In FIG. 9 a tray 57 has a flat cover sealed thereto by being joined to the tray rim. A zipper extends longitudinally down the center of the tray parallel to the side edges and the zipper has pull flanges 59 and 60. At the base of the pull flanges are webs 61 and 62 which are sealed to the top surface of the cover 58, as in FIG. 8, but are then cut along line 63 to allow them to stand up. This arrangement would be used where barrier properties to protect the tray contents are not needed.

While in each of the instances the tray is shown as rectangular in shape with the closure zipper extending down the edge or down the center parallel to the side edges, it will be understood that trays of varying shapes may be employed and it is not essential that the opening zipper be positioned parallel to the side edges but can be at an angle or at a different location. In the arrangement of FIGS. 1 and 2, the zipper closure is formed separate from the cover and is shown at the edge of the tray, but it can be located inwardly from the edge. When the opening is centrally located as illustrated in the arrangements of FIGS. 3, 5, 7 through 9, end forces on the semi-flexable tray will separate the opening for easy access to the contents. Of course, the zipper strips must be separated before applying the end forces to spread the opening in the cover, and the weakened line of tear resistance has to be broken. Alternately, pulling the zipper flanges apart will also provide access to the contents of the tray.

Figure 10:
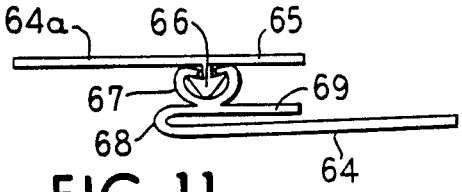
FIG. 10 is a fragmentary sectional view taken through a reopenable closure portion of a cover illustrating a form of closure.

FIG. 10 illustrates a structure wherein the fastener is part of the cover and is arranged so as to resist inadvertent separation of the profiles. In FIG. 10 the cover is shown in two portions at 64 and 64*a* with an opening between said portions and with the upper portion of said cover extending over the opening to provide a top pull flange 65. The lower portion below the opening is doubled at 68 so as to provide a pull flange 69. On the inner facing surfaces of the pull flanges 65 and 69 are rib and groove elements 66 and 67 which interlock. The lower flange which is doubled at 68 has a hinge action and the doubled portion 68 provides the hinge to resist opening due to flexing of the cover or of the tray. The cover and profies can be made of one portion, in which case the construction shown in FIG. 14 or 15 will apply.

Figure 11A:
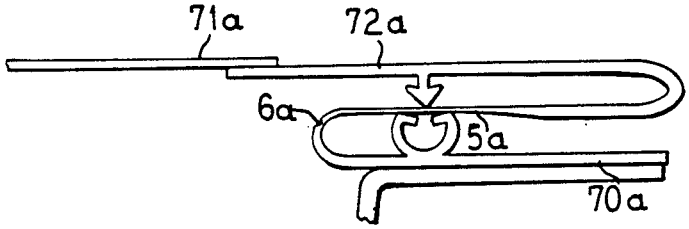
FIG. 11A is a fragmentary sectional view similar to FIG. 11 illustrating a form of fastener similar to FIG. 11.
Figure 11B:
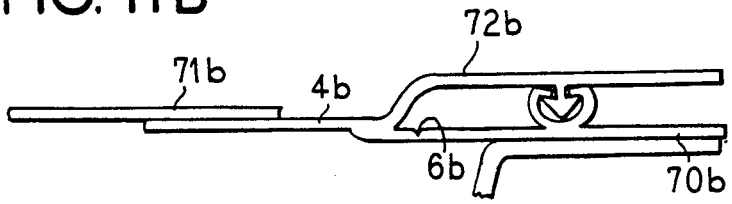
FIG. 11B is a fragmentary sectional view illustrating another reopenable closure somewhat similar to FIG. 11.
Figure 11:
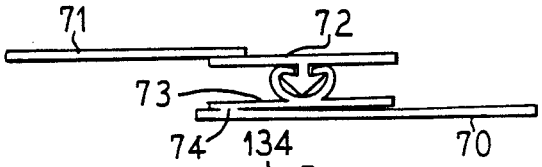
FIG. 11 is a fragmentary sectional view similar to FIG. 10 and illustrating another form of closure.

FIG. 11 illustrates another construction somewhat similar to FIG. 10, but the fastener strips, rather than being integral with the cover material, are separate and are attached to the cover. The cover has a portion 70 and a portion 71 which extend toward each other to provide an opening therein. Fastener strips include an upper strip 72 secured to the upper cover layer 71 and a lower strip 73 secured at 74 to the lower cover portion 70. The location 74 where the strips are secured is offset from the profiles of the strip so that at 74 a hinge is provided which resists inadvertent separation of the profiles and opening.

FIGS. 11A and 11B illustrate modified forms of a fastener strip used to seal a tray cover, somewhat similar to FIG. 11.

In the arrangement of FIG. 11A, a fastener strip assembly including an upper strip 72*a* and a lower strip 70*a* is attached with the upper strip being bonded to a cover 71*a* for the tray and the lower strip 70*a* being bonded to the rim of the tray. The fastener strips have mating interlocking profiles and attached between the ends of the upper strip 72*a* and the lower strip 70*a* is a film gasket 5*a* which seals the ends. This gasket provides a moisture-proof and air-proof seal protecting the contents of the tray. When the user purchases the tray, he obtains a tamper-evident fastener so that he can visually determine whether the tray has been opened before his purchase. For use, the gasket 5*a* is broken to provide access to the contents of the tray and the fastener strip will then close and open in the usual manner to reseal the tray and to again have access thereto. A line of weakened tear resistance in the gasket strip can be provided, so that the gasket strip can continue to be combined with the fastener to provide a better air and moisture proof seal.

FIG. 11B illustrates another form of fastener strip wherein the fastener has a lower strip 70*b* and an upper strip 72*b* joined by interlocking rib and groove elements. The upper and lower strip are joined to each other by a web portion 4*b* which is bonded to a cover 71*b* of the tray. The lower strip 70*b* is then bonded to the rim of the tray. The lower strip has a line 6*b* of weakened tear resistance which is frangible to gain access to the contents of the tray. In use, the purchaser pulls upwardly on the upper strip and breaks the frangible line 6*b*. By lifting the upper strip, the user can visually determine whether the seal has been broken so that the arrangement provides a tamper-evident closure. After the frangible line has been broken, the tray can be opened and reclosed by virtue of the fastener strips being pulled apart and rejoined.

Figure 12:
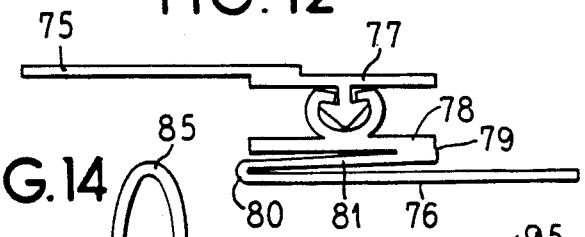
FIG. 12 is a fragmentary sectional view similar to FIG. 10 and illustrating still a further form of closure.

In FIG. 12 a further arrangement is illustrated wherein an openable fastener strip is attached to cover material 76 at one side of the opening and to cover material 75 at the other side of the opening. Fastener strips 77 and 78 are located in the opening. Fastener strip 77 is attached to upper cover material 75. The lower cover material 76 is doubled at 80 and folded back to form a flap 81. This is attached at its distal edge to the lower fastener strip 78. This provides a hinge at 79 offset from the profiles of the fastener strips to resist opening. The lower doubled portion at 80 also provides a second hinge further essentially providing an expandable accordion fold to allow extra material which will resist inadvertent separation of the profiles due to stresses on the cover or on the tray.

Figure 13:
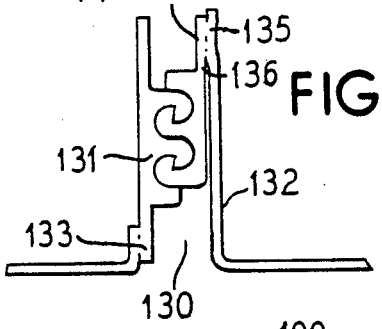
FIG. 13 is a fragmentary sectional view illustrating a form of closure wherein upstanding pull flanges are used.

FIG. 13 illustrates the concept of a hinge zipper strip utilized with the closure fastener in an upstanding posture. A cover has an opening at 130 with edges at the sides of the opening upwardly. A fastener for the opening has a lower web portion 133 and an upper web portion 134 which are to be secured to the folded surfaces of the cover on either side of the opening. Upstanding closure strip 131 extends upwardly having a profile on its inner face. The closure has an additional strip portion 136 with a profile which mates with the profile of the strip 131. The strip 136 is secured at its upper edge portion 134 at 135 to an upstanding portion 132 of the cover so that at 135 a hinge is provided which is offset from the profiles and resists opening with stresses on the sides of the cover adjacent the opening 130.

Figure 14:
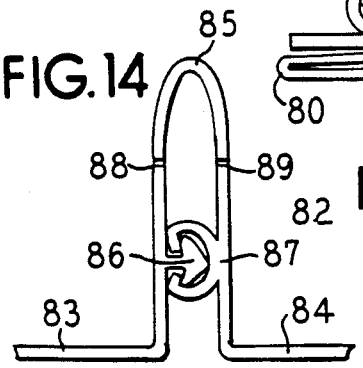
FIG. 14 is a fragmentary vertical sectional view, similar to FIG. 13, but illustrating another form of closure.

FIG. 14 illustrates a further arrangement wherein a one-piece zipper strip 82 is constructed to be secured to a flat cover on a tray. The tray cover may have a line of weakened resistance therealong, not shown, such as the perforation line 30 in FIG. 4 or the perforation line 40 in FIG. 6.

The zipper strip has lateral web portions 83 and 84 which can be secured to the surface of the cover. In some forms, the zipper may be integral with the cover wherein a cover is originally formed of a material extruded so as to have rib and groove profiles 86 and 87 integral therewith. The strip is continuous to be doubled at its top edge 85. The doubled portion has lines of weakened tear resistance such as perforations 88 and 89 so that the top part of the strip can be torn off at the time of use. This provides a tamper-evident closure inasmuch as the purchaser can see that the container has not been opened prior to purchase. At the time of use, the top portion is torn off to leave upstanding pull flanges for separation of the rib and groove elements and access to the interior of the tray.

Figure 15:
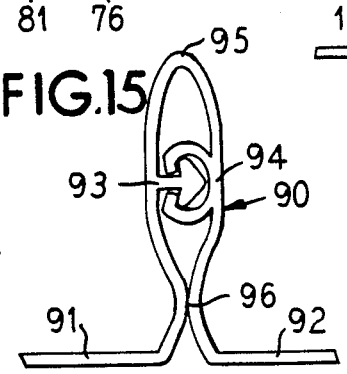
FIG. 15 is a fragmentary vertical sectional view, similar to FIG. 13 and illustrating another form of closure.

In FIG. 15 a construction somewhat similar to FIG. 14 is employed, but a frangible juncture or seal is provided at 96 below rib and groove elements 93 and 94 on the strip 90. The fastener strip has base web portions 91 and 92 which are either integral with the cover or to be attached thereto. The strip is doubled and continuous at its outer edge 95, and for use the outer edge is severed to provide upstanding pull flanges which pull apart the rib and groove elements.

Figure 16:
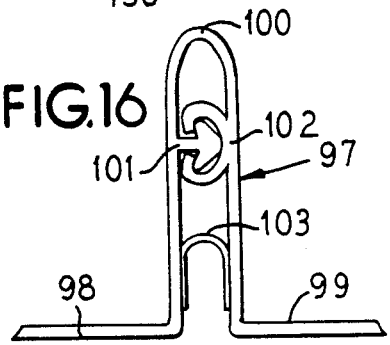
FIG. 16 is a fragmentary vertical sectional view, similar to FIG. 13 and illustrating another form of the closure.

In the arrangement of FIG. 16, again a continuous one-piece fastener strip 97 is provided. The strip has lateral web portions 98 and 99 which are part of the cover or to be attached thereto. The strip is doubled at 100. Profiles 101 and 102 are on the inner surface of the strip. To provide a moisture and air-tight juncture, a bridging seal 103 is secured to the inner surfaces of the strip below the profiles. Thus, even when the outer portion 100 of the strip is separated and the rib and groove are pulled apart, the purchaser can observe that the container has remained sealed and the bridging portion 103 can be cut or torn apart for access to the contents of the tray. Bridging portion 103 can be integral with the fastener strip 97 or separately applied, and the bridging strip can be used instead of the double part of the strip 100, which can be slit before use by the end user with the portion 103 then providing the tamper-evident seal.

FIG. 17 illustrates a manner in which a continuous row of trays is handled and closed. The semi-flexible trays 104 are manufactured in a continuous row and fed from right to left as shown in FIG. 17. A cover material is fed off of a supply roll 106 with the material fed off at 105 to be laid over the top of the trays. Spaced zipper strips 108 have already been attached to the cover material and an applying roller 107 presses the cover material down onto the top of the trays. The strips are shown arranged in separated units 108 so as to match with the tops of the trays. When the trays and covers progress, a heated sealing mandril 109 is pushed down onto the top of the cover to seal the edges to the rim of the tray. As the tray progresses, a cutting knife **109*a*** separates the trays from the continuous supply so that an individual completed separate tray is received with its cover in place. Presumably, the contents will be placed in the tray immediately before the cover is applied.

FIG. 19 illustrates in greater detail the application of the mandril 109. The mandril is shown as rectangular in shape to correspond to the shape and size of the rim of the tray 104. Uniquely, the mandril has slots 110 and 111 which are in a position to match with and receive the upstanding zipper strip 108.

FIG. 20 illustrates a similar operation wherein the zipper strip is to be flattened to have the resultant structure illustrated in FIGS. 8 or 9. In this case, a mandril 122 is also rectangular in shape so as to match the shape and size of the rim of a tray 117 and heat seal cover material 118. An upstanding zipper strip 119 is flattened and sealed to the cover at locations 120 and 121.

FIG. 18 illustrates application of the principles to trays formed in double rows with one row of trays at 112 and a second row at 113.

Cover material 114 is fed onto the top of the trays after they have been filled and are moved forward with the material and the trays moving in the direction indicated by the arrowed line 128. The cover material will have the upstanding zipper strips 115 and 116 already installed on the cover 114.

In some instances, it may be desirable to feed in the cover material laterally as shown by the arrowed line **128*a* where cover material 114*a* is fed sideways over the top of the trays 112 and 113**.

In FIG. 21 heating bars 125 and 126 are moved in the directions indicated by the arrowed lines to form appropriate sealing and are shown in their final position by the dotted line position 124. A tray 122 has cover 123 thereon with an upstanding zipper strip 127 and the bars 125 and 126 seal the cover 123 to the rim and also provide an end seal on the vertical zipper strip so that the end seal has the final appearance of the structure shown in FIG. 7.

The heating bars 125 and 126 are shown somewhat schematically but in greater detail in FIG. 22. Suitable means such as an embedded element heat the bars and for sealing the cover to the top of the tray, the bars are brought down vertically onto the cover to heat bond the cover to the rim of the tray. The bars are U-shaped and of a size to correspond with the size of the tray rim. The bars are brought laterally together so that the base surfaces of the U **128*a* and 129*a* at one side of the tray and 128*b* and 129*b*** at the other side are brought up against the upstanding pull flange portions of the fastener to bond the ends.

Suitable mechanical means are provided for moving the U-shaped heating elements vertically down against the tray as indicated schematically by the vertical line 130. Suitable mechanical means are also provided to move the U-shaped sealing bars laterally as indicated schematically by the horizontal arrowed lines 131. Alternately, the bars can be brought into position diagonally in one operation.

With a reclosable zipper extending along the top of the tray, access to the contents within the tray is made simple by separating the zipper and reaching in to remove a portion or all of the contents. If a portion is removed, the tray can be used for storage by rejoining the rib and groove zipper which results in an air-tight and moisture-tight seal for the tray, except in the case of FIG. 9. An advantage afforded by this construction is that the semi-rigid nature of the tray permits a bending of the side walls when the ends are pushed inward. This separates or bows out the confronting sides of the flange so that an oblong opening is provided to reach into the tray. For example, in viewing a structure such as shown in FIG. 3, when the user separates the fastener 24 at the top and then pushes inwardly on the end walls, the upstanding flanges will separate to provide an opening so that the user can reach into the tray to remove the contents, or to place new contents into the tray. This type of tray normally has sufficient resilience that it will spring back when released so that the flanges at the side of the flexible fastener will move back together so that the profiles can be rejoined. Alternately, the zipper flanges, when pulled apart will also create an opening into the tray.

Thus, it will be seen that we have provided an improved method for producing a structure which is well suited to high speed packaging operation well suited to the packaging of foodstuffs and other perishables at decreased cost. The resultant tray is reclosable providing advantages over trays which can be opened only be destruction of the cover. The present tray and cover provide no substantial increase in cost over trays of the type heretofore available and yet afford usefulness in consumer attractiveness not heretofore possible. The method and structure meet the objectives and advantages above set forth and provide various arrangements within the scope and spirit of the invention which may be employed for improved protective packaging.

We claim as our invention:

1. A method of closing a tray having a recess for contents with a continuous edge rim comprising the steps:

laying a flexible plastic cover over the tray contents and sealing the cover to said edge rim;

laying an elongate fastener over the cover, said elongate fastener having facing interlocking rib and groove profiles on pull flanges with attachment webs at the base; and sealing said attachment webs to the outer surface of the cover so that the flanges and profiles may be separated for access to the tray contents through an opening in the cover.

2. A method of closing a tray having a recess for contents with a continuous edge rim in accordance with the steps of claim 1:

wherein the pull flanges have a lower web portion extending laterally outwardly from the pull flanges parallel to the cover with the web portions joined in face-to-face surface seals to the cover.

3. A method of closing a tray having a recess for contents with a continuous edge rim in accordance with the steps of claim 1:

wherein said pull flanges have a common attachment web at the base turned inwardly from each of the pull flanges and being of one piece.

4. A method of closing a tray having a recess for contents with a continuous edge rim in accordance with the steps of claim 1:

wherein the cover and fastener are heat sealed to the rim by the application of a heated sealing bar having a configuration conforming to the shape of said rim.

5. A method of closing a tray having a recess for contents with a continuous edge rim in accordance with the steps of claim 4:

wherein said bar has recesses for receiving the ends of the fastener.

6. A method of closing a tray having a recess for contents with a continuous edge rim in accordance with the steps of claim 1:

wherein a plurality of trays are provided joined at their edge rims and a flexible plastic cover with a plurality of fasteners is laid over said plurality of trays and sealed over the trays.

7. A method of closing a tray having a recess for contents with a continuous edge rim in accordance with the steps of claim 6:

wherein said trays are moved in an assembly direction and said covers with said fasteners are moved with the tray in said assembly direction and oriented relative to said trays.

8. A method of closing a tray having a recess for contents with a continuous edge rim in accordance with the steps of claim 6:

wherein said trays are fed forwardly in an assembly direction and said plastic cover with said fasteners is fed onto the trays in a direction at right angles to said assembly direction.

9. A method of closing a tray having a recess for contents with a continuous edge rim comprising the steps:

laying a flexible plastic cover over the tray contents and sealing the cover to the edge rim of the tray;

laying an elongate fastener over the cover with the fastener having first and second strips with facing interlocking rib and groove profiles between the strips and a pull flange for each of the strips with attachment webs at the base of the strips;

sealing said attachment webs to the cover so that the flanges may be pulled apart and the profiles separated for access to the tray contents between the strips through an opening in the cover;

and joining said strips independent of the profiles so that a tamper-evident seal is formed between the strips.

10. A method of closing a tray having a recess for contents with a continuous edge rim in accordance with the steps of claim 9:

wherein said strips are joined outwardly of the profiles.

11. A method of closing a tray having a recess for contents with a continuous edge rim in accordance with the steps of claim 9:

wherein said strips are joined inwardly of the profiles.

12. A method of closing a tray having a recess for contents with a continuous edge rim in accordance with the steps of claim 9:

wherein the strips are doubled to be joined by an integral part of the strips.

13. A method of closing a tray having a recess for contents with a continuous edge rim in accordance with the steps of claim 9:

including attaching a bridging seal between the strips so that the bridging strip can be separated for access to the contents of the tray.

14. A method of closing a tray having a recess for contents with a continuous edge rim in accordance with the steps of claim 9:

wherein said strips are joined by a membrane extending between the strips.

15. A method of closing a tray having a recess for contents with a continuous edge rim in accordance with the steps of claim 14:

wherein said membrane is attached to the pull flange of one of the strips and attached below the profiles on the other strip so as to extend between the profiles.

16. A method of closing a tray having a recess for contents with a continuous edge rim in accordance with the steps of claim 14:

wherein the membrane is attached at its ends to each of the strips below the profiles.

17. A method of closing a tray having a recess for contents with a continuous edge rim in accordance with the steps of claim 14:

wherein the membrane is attached to each of the strips above the profiles.

* * * * *